US007497253B2

(12) United States Patent
Retallick et al.

(10) Patent No.: US 7,497,253 B2
(45) Date of Patent: Mar. 3, 2009

(54) DOWNHOLE STEAM GENERATOR

(75) Inventors: William B. Retallick, 1432 Johnny's Way, West Chester, PA (US) 19382; William A. Whittenberger, Leavittsburg, OH (US)

(73) Assignee: William B. Retallick, West Chester, PA (US)

( * ) Notice: Subject to any disclaimer, the term of this patent is extended or adjusted under 35 U.S.C. 154(b) by 0 days.

(21) Appl. No.: 11/847,527

(22) Filed: Aug. 30, 2007

(65) Prior Publication Data

US 2008/0053655 A1 Mar. 6, 2008

Related U.S. Application Data

(60) Provisional application No. 60/824,692, filed on Sep. 6, 2006.

(51) Int. Cl.
*E21B 36/02* (2006.01)
*E21B 43/24* (2006.01)

(52) U.S. Cl. ..... 166/59; 261/78.1

(58) Field of Classification Search ..... None
See application file for complete search history.

(56) References Cited

U.S. PATENT DOCUMENTS

| | | | | |
|---|---|---|---|---|
| 4,024,912 | A * | 5/1977 | Hamrick et al. | 166/57 |
| 4,380,267 | A * | 4/1983 | Fox | 166/303 |
| 4,445,570 | A | 5/1984 | Retallick | |
| 4,545,430 | A | 10/1985 | Retallick | |
| 7,179,313 | B2 | 2/2007 | Retallick | |

* cited by examiner

*Primary Examiner*—Zakiya W. Bates
(74) *Attorney, Agent, or Firm*—William H. Eilberg

(57) ABSTRACT

In a downhole steam generator, hydrogen, oxygen, and water are separately injected into an oil well. The hydrogen and oxygen are made to react, either with the aid of a catalyst or due to an electric spark. Heat from the reaction converts the water in the area into steam, which is then used to enhance the production of the oil well. The hydrogen may be produced at the surface of the well by the steam reforming of a hydrocarbon. The hydrogen injected into the well may be provided as part of a reformate mixture produced by the steam reforming process. The water is preferably atomized by the stream of oxygen immediately before ignition, so as to provide a maximum surface area for heat absorption.

4 Claims, 2 Drawing Sheets

DOWNHOLE STEAM GENERATOR

CROSS-REFERENCE TO PRIOR APPLICATION

Priority is claimed from U.S. provisional patent application Ser. No. 60/824,692, filed Sep. 6, 2006, the disclosure of which is incorporated by reference herein.

BACKGROUND OF THE INVENTION

This invention relates to the field of oil production, and provides a system and method for generating steam downhole in an oil well, to enhance production. The invention is especially suitable for producing heavy oil from oil sands.

The production of oil from a reservoir slows down as the reservoir is depleted, because the remaining oil is more viscous, and flows more slowly towards the production well. Some reservoirs have heavy oil which flows slowly from the beginning.

It has been known, in the prior art, to inject steam into a reservoir, to heat the oil, reducing its viscosity, and to drive the oil towards the production well. U.S. Pat. Nos. 4,445,570 and 4,545,430, the disclosures of which are incorporated herein, disclose systems used in downhole steam generators.

The present invention provides an improvement over the prior art, insofar as it discloses a system which does not require the downhole burning of hydrocarbons for production of heat for generating steam.

SUMMARY OF THE INVENTION

The method of the present invention comprises separately injecting hydrogen, oxygen, and water into an oil well. The well may be a lateral well in a formation of oil sands. The hydrogen may be pure, or it may be provided as part of a reformate mixture comprising hydrogen, carbon monoxide, carbon dioxide, and water. The hydrogen and oxygen are made to react, in a downhole region. The reaction is initiated either catalytically, or by an electric spark from an ignition device. The heat of the reaction converts the water in the downhole region into steam. Thus, the steam is produced downhole, and does not have to be piped from a source above ground level.

The hydrogen, oxygen, and water are provided through separate conduits, extending from above ground level to the downhole region. The components are delivered at greater than atmospheric pressure, of the order of 10-100 atmospheres. The oxygen is at a higher pressure than the hydrogen and the water. This excess pressure is used to atomize the water prior to ignition. The components can be delivered in proportions such that the temperature of the resulting steam is about 500° C.

The hydrogen may be produced by the steam reforming of a hydrocarbon at or near the surface of the well. Excess heat input to the reforming reaction can be used downhole, to help to generate steam, and is not wasted.

Another aspect of the invention includes an atomizer, in which the incoming stream of oxygen is used to atomize the stream of water. The atomizer includes a separate channel for introduction of hydrogen, so that the hydrogen and oxygen can be ignited just as the mist of water is ejected from the atomizer. Atomization of the water is necessary to provide the required surface area for heat absorption.

The present invention therefore has the primary object of providing a method and apparatus for generating steam downhole in an oil well.

The invention has the further object of improving the efficiency of oil production, by providing steam for driving heavy oil out of a reservoir and into a production well.

The invention has the further object of providing a system and method for generating steam downhole in an oil well, wherein it is not necessary to burn a hydrocarbon downhole to produce the steam.

The invention has the further object of providing a method and apparatus for generating steam downhole, wherein the temperature of the steam can be controlled.

The invention has the further object of providing an atomizer for use in generating steam downhole in an oil well.

The invention has the further object of providing a system and method wherein oxygen, hydrogen, and water are injected separately into an oil well, and in which the oxygen is at a higher pressure than the water and the hydrogen, so that the excess pressure is used to atomize the water immediately prior to ignition.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
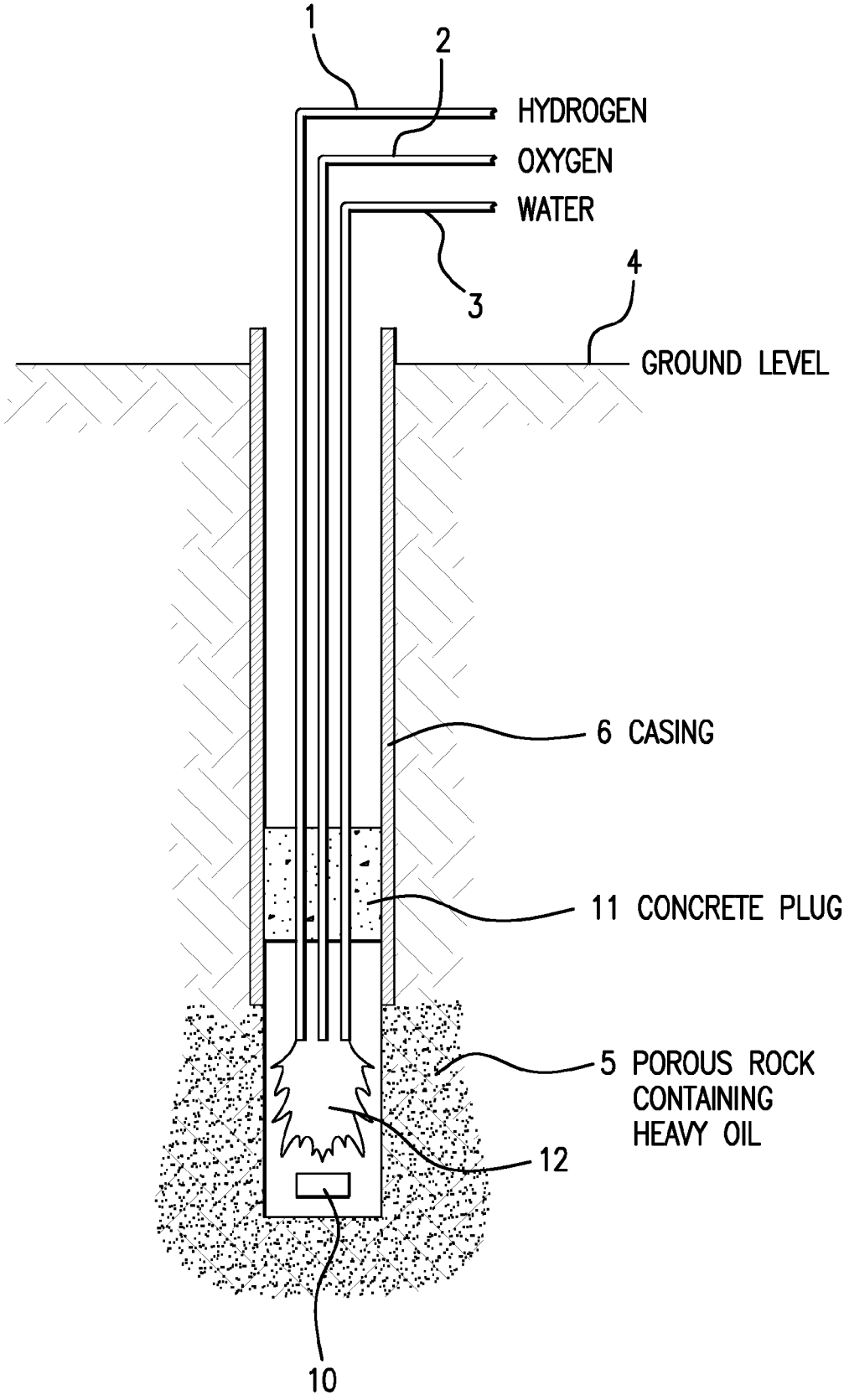
FIG. 1 provides a schematic diagram of a system used to practice the present invention.

The present invention includes the process of separately injecting hydrogen, oxygen, and water, into an oil well, and causing the hydrogen and oxygen to react downhole, forming heat and more water. The heat produced by the reaction heats the water, thereby producing steam.

For optimum production of steam, the water should be atomized. Atomization provides the necessary surface area of the water for the absorption of heat.

In one preferred embodiment, the hydrogen, oxygen, and water are separately injected into a lateral well in a formation containing oil sands. The hydrogen and the water are supplied at the pressure in the sealed off lateral well. The oxygen is supplied at a higher pressure. This pressure difference is used to atomize the water. Stated another way, the energy for the atomizing step is provided by expanding the oxygen in the vicinity of the water.

The hydrogen used in the present invention may be pure hydrogen, or it may be part of a "reformate" mixture comprising hydrogen, carbon monoxide, carbon dioxide, and water. As used in the present specification, the term "hydrogen" is intended to include both pure hydrogen and a reformate mixture containing hydrogen.

The downhole steam generator of the present invention could receive hydrogen, oxygen, and water, in the following proportions:

| | |
|---|---|
| Hydrogen | 2.0 mols |
| Oxygen | 1.0 mol |
| Liquid water | 3.7 mols |

When the components are provided in the above proportions, the product is steam at 500° C.

Each component is delivered downhole, in a separate conduit, each component being at a pressure which is greater than atmospheric pressure. The preferred pressures are in the range of about 10-100 atmospheres. The hydrogen and oxygen are reacted together, with or without a catalyst. When the amount of liquid water is exactly 3.7 mols, the temperature of the steam is 500° C. If this steam were generated at ground level and piped downhole, much heat would be lost. In general, the proportions of the components can be chosen to achieve a desired temperature for the steam.

Steam is the only product of the reaction between hydrogen and oxygen. There are no significant amounts of inert gases that have to be forced into the reservoir or vented to ground level.

The hydrogen may be produced at ground level by steam reforming a hydrocarbon. Oxygen of sufficient purity can be produced by pressure swing adsorption (PSA) or by a gas-separation membrane. The water injected into the reservoir should be de-ionized to prevent plugging of the formation with solid minerals.

A process and apparatus for producing the hydrogen is described in copending U.S. patent application Ser. No. 10/347,130, filed Jan. 17, 2003, and published on Feb. 5, 2004 as patent publication No. US 2004-0020125 A1. The disclosure of the latter application is hereby incorporated by reference. The apparatus disclosed in the cited application could be provided at ground level.

When hydrogen is produced at the surface using a steam reformer, as stated above, typically methane is reformed at the surface with steam, and the hot, reformed product is sent downhole directly, together with oxygen and water. The oxygen, hydrogen, and steam must be sent downhole in separate conduits.

In a typical steam reforming process, one mol of methane is reformed with 3 mols of $H_2O$ at 1000° K. to produce:

| | |
|---|---|
| $H_2$ | 3.39 mols |
| $CO_2$ | 0.39 mols |
| CO | 0.61 mols |
| $H_2O$ | 1.61 mols |

The above composition, which comprises the reformate mixture, is sent downhole in its own conduit. Two mols of oxygen are sent downhole in a separate conduit. The hydrogen is oxidized to $H_2O$ and the CO is oxidized to $CO_2$. Also, 16.9 mols of liquid water are sent downhole in a third conduit. The two mols of oxygen are delivered at a pressure sufficient to atomize the 16.9 mols of water. The final mixture will have a temperature of 500° C., as before.

An advantage of the above-described process is that the heat input to the reforming process is not wasted, i.e. it goes down the well and is used in generating steam downhole.

FIG. 1 shows a system for operating the process of the present invention. Hydrogen, oxygen, and water are injected through separate conduits 1, 2, and 3, respectively. The conduits are accessible from above ground level 4, and extend into reservoir 5. The well is defined by casing 6. The well sits within a formation comprising porous rock containing heavy oil.

FIG. 1 shows flame 12, which results from the reaction of hydrogen and oxygen. This reaction is ignited either with a catalyst, or with an electric spark produced by igniter 10. The catalyst could be provided on the inside surface of casing 6, or it could be provided on a separate support (not shown) at or near the bottom of the well.

Concrete plug 11 helps to support the casing, and prevents water, which may be released from the surrounding formation during drilling, from filling the well.

Figure 2:
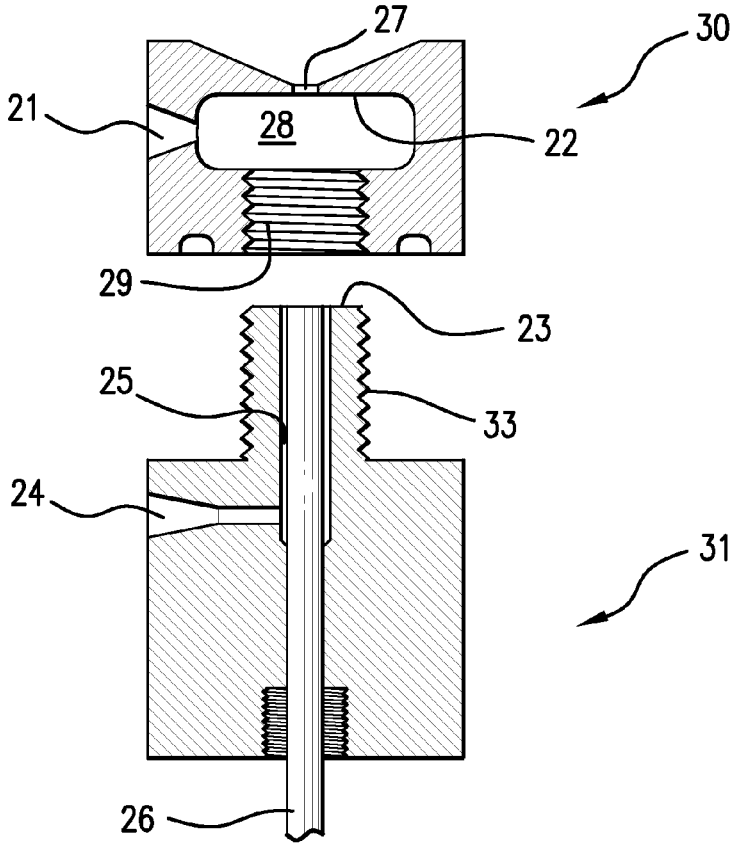
FIG. 2 provides an exploded cross-sectional view of an atomizer used for the conversion of water to steam, in the present invention.
Figure 3:
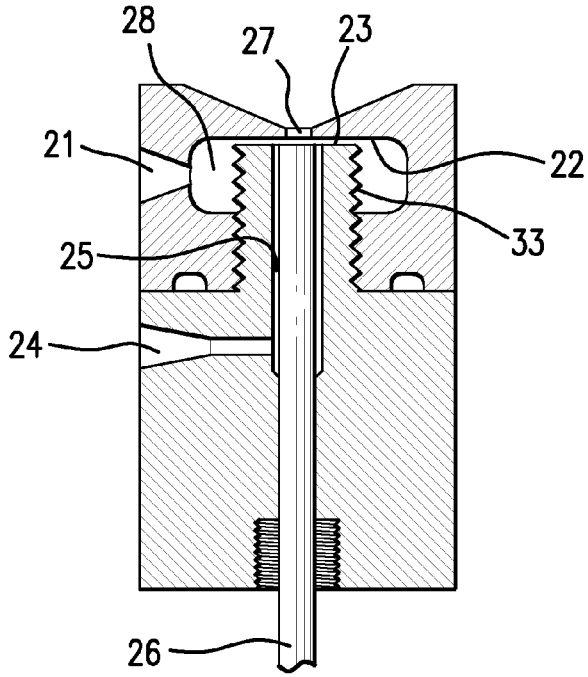
FIG. 3 provides a cross-sectional view of the atomizer of FIG. 2, showing the sections of the atomizer in their assembled state.

FIGS. 2 and 3 illustrate an atomizer which is used to atomize the water immediately before it is converted to steam. The atomizer is positioned in the vicinity of the outlets of the conduits 1, 2, and 3 of FIG. 1. The atomizer is formed in two sections, as shown in FIG. 2, a lower section 31 being capable of being screwed into an upper section 30, as shown in FIG. 3. The upper section 30 includes chamber 28 which receives incoming water. The upper section also includes threaded passage 29 and outlet hole 27. The sections 30 and 31 are screwed together such that there is a small gap between interior surface 22, defined by upper section 30, and surface 23, which is at the forward end of the male threaded member 33 of lower section 31.

Water enters through entry duct 21, which comprises means for introducing water into the atomizer. The water forms a thin sheet between surfaces 22 and 23, and flows radially inward when the two pieces have been screwed together. Oxygen enters through entry duct 24, which comprises means for introducing the oxygen. The oxygen flows upward through annular space 25. The upflowing oxygen atomizes the sheet of water that is emerging from the gap between surfaces 22 and 23.

Hydrogen enters through entry duct 26, and mixes with the oxygen and the atomized water in the vicinity of hole 27. The mixture is ignited in the immediate vicinity of hole 27. Thus, duct 26 comprises means for separately directing hydrogen towards the outlet hole.

The water must be atomized so that it presents the necessary surface area for heat absorption. The design of the atomizer is part of this invention. Instead of hydrogen, methane or some other fuel gas could be used here.

The sheet of water that is flowing between surfaces 22 and 23 is in laminar flow. The profile of fluid velocity across the thickness of the sheet is a parabola. That is, the fluid velocity is maximum at or near the midpoint of the gap between surfaces 22 and 23, and is a minimum immediately adjacent to each such surface. The total flow is proportional to the third power of the spacing between the surfaces. Uniform atomization requires that the spacing be constant. The present construction provides a constant spacing.

In one example, a prototype atomizer was built from tubing having an outside diameter of about 1.75 inches. That is, the outside diameter of the structure shown in FIGS. 2 and 3 was about 1.75 inches. For this size atomizer, it was found that the optimum size of the gap, i.e. the distance between surfaces 22 and 23, was of the order of a few thousandths of an inch. More particularly, it was found that the optimum size of the gap was in the range of about 0.001-0.003 inches.

However, if the atomizer were much larger, the absolute value of the optimum size of the gap would likely be larger as well. Therefore, the invention should not be deemed limited to a particular size of gap.

The atomizer of the present invention provides its own means for experimentally determining the necessary size of the gap. One simply directs water into the entry duct 21 while screwing the lower section 31 of the atomizer into, or out of, the upper section 30. That is, the atomizer allows continuous adjustment of the size of the gap. As one makes this adjustment, the stream of water exiting hole 27 changes in character, ranging from a solid stream of water, to a series of droplets, to a mist. The presence of a mist indicates that the gap is set at the optimum size. Thus, one simply adjusts the lower section until a mist exits the atomizer, and one leaves the atomizer in this position.

The reader skilled in the art will recognize that the invention can be modified in various ways. Such modifications should be considered within the spirit and scope of the following claims.

What is claimed is:

1. An atomizer for use in mixing hydrogen, oxygen, and water downhole in an oil well, comprising:

a) an upper section comprising an entry duct in fluid communication with a chamber formed in the upper section, the chamber having an upper interior surface, the upper interior surface being generally flat, the chamber also including an outlet hole, b) a lower section comprising a lateral entry duct and an axial duct, and an annular space surrounding the axial duct, wherein the lateral entry duct is in fluid communication with the annular space, the lower section including a male threaded member, the male threaded member having a forward end surface, the forward end surface being generally flat, wherein the upper and lower sections are screwed together such that the forward end surface of the male threaded member and the upper interior surface of the upper section are spaced apart to form a small gap.

2. The atomizer of claim 1, wherein the gap has a size in a range of about 0.001-0.003 inches.

3. An atomizer for use in mixing hydrogen, oxygen, and water downhole in an oil well, comprising:

an entry duct in fluid communication with a chamber, the chamber having a gap defined by a pair of generally flat, spaced apart surfaces, the chamber also having an outlet hole, the entry duct comprising means for introducing water into the chamber, and means for directing oxygen towards the chamber so as to atomize water entering through said entry duct, and means for separately directing hydrogen towards said outlet hole.

4. The atomizer of claim 3, wherein the gap has a size in a range of about 0.001-0.003 inches.

* * * * *